US006499170B2

(12) United States Patent
Kim et al.

(10) Patent No.: US 6,499,170 B2
(45) Date of Patent: Dec. 31, 2002

(54) SEISMIC LOAD TRANSMITTING SYSTEM BASED ON IMPACT MECHANISM FOR MULTI-SPAN CONTINUOUS BRIDGES

(75) Inventors: Jae Kwan Kim, Daerim Apartment 6-109, Jamwon-dong, Seocho-ku, Seoul, 137-947 (KR); Ick Hyun Kim, Seoul (KR)

(73) Assignee: Jae Kwan Kim, Seoul (KR)

( * ) Notice: Subject to any disclaimer, the term of this patent is extended or adjusted under 35 U.S.C. 154(b) by 46 days.

(21) Appl. No.: 09/828,726

(22) Filed: Apr. 9, 2001

(65) Prior Publication Data

US 2001/0029711 A1 Oct. 18, 2001

(30) Foreign Application Priority Data

Apr. 12, 2000 (KR) ..... 00-19139

(51) Int. Cl.[7] ..... E01D 19/04; E04H 9/02; E04B 1/98

(52) U.S. Cl. ..... 14/73.5; 52/167.1; 52/167.4; 52/167.8

(58) Field of Search ..... 14/73.5, 74.5, 14/76, 78; 52/167.1, 167.4, 167.8

(56) References Cited

U.S. PATENT DOCUMENTS

| | | | | | |
|---|---|---|---|---|---|
| 3,349,418 | A | * | 10/1967 | Hein | 14/73.5 |
| 3,806,975 | A | * | 4/1974 | Fyfe | 14/73.5 |
| 3,921,240 | A | * | 11/1975 | Fyfe | 14/73.5 |
| 4,187,573 | A | * | 2/1980 | Fyfe et al. | 14/73.5 |
| 4,527,365 | A | * | 7/1985 | Yoshizawa et al. | 267/154 |
| 4,910,930 | A | * | 3/1990 | Way | 52/167.1 |
| 4,938,633 | A | * | 7/1990 | Wu et al. | 376/285 |
| 5,215,382 | A | * | 6/1993 | Kemeny | 14/73.5 |
| 5,327,692 | A | * | 7/1994 | Yano et al. | 248/636 |
| 5,456,047 | A | * | 10/1995 | Dorka | 248/568 |
| 5,505,026 | A | * | 4/1996 | Intilla | 14/73.5 |
| 5,713,162 | A | * | 2/1998 | Gallo et al. | 52/167.1 |
| 5,918,339 | A | * | 7/1999 | Marioni et al. | 14/73.5 |

FOREIGN PATENT DOCUMENTS

| | | | |
|---|---|---|---|
| JP | 55-92415 | * | 7/1980 |
| JP | 9-177372 | * | 7/1997 |
| JP | 2000-352063 | * | 12/2000 |

* cited by examiner

*Primary Examiner*—Gary S. Hartmann
(74) *Attorney, Agent, or Firm*—Head, Johnson and Kachigian

(57) ABSTRACT

Disclosed is a seismic load transmitting system based on impact mechanism for a multi-span continuous bridge. There are impact assemblies connected to a superstructure of the bridge for colliding with movable support piers according to a longitudinal displacement of the superstructure of the bridge caused by a seismic load. The seismic load is transmitted from the superstructure of the bridge to the movable support piers. These are impact receiving assemblies installed in the movable support piers for receiving an impact force generated when the movable support piers become collided with the impact assemblies and transmitting the seismic load transferred from the superstructure of the bridge through the impact assemblies to the movable support piers. The seismic load generated in the superstructure of the bridge is transmitted not only to the fixed support piers but also to the moving support piers due to the collision between the impact assemblies and the impact receiving assemblies. The contact plate of the impact receiving assembly has a curved surface of a predetermined curvature.

7 Claims, 10 Drawing Sheets

SEISMIC LOAD TRANSMITTING SYSTEM BASED ON IMPACT MECHANISM FOR MULTI-SPAN CONTINUOUS BRIDGES

BACKGROUND OF THE INVENTION

1. Field of the Invention

The present invention generally relates to a seismic load transmitting system for multi-span continuous bridges, and more particularly, to a seismic load transmitting system based on impact mechanism for multi-span continuous bridges, which can improve earthquake resistance capacity of a bridge by transmitting seismic load from the superstructure not only to fixed support piers of the bridge, but also to movable support piers of the bridge.

2. Description of the Related Art

Recently, multi-span continuous bridges are widely used. In general, such a multi-span continuous bridge is designed to have a single fixed point in the longitudinal direction of the bridge. FIG. 6*a* shows an example of the conventional multi-span continuous bridge. In the conventional 4-span continuous bridge, a fixed support 121 is installed on a fixed support pier 120, which is located in the middle of the 4-span continuous bridge, to restrict the longitudinal movement of the 20 superstructure 100 of the bridge. Movable supports 122 are installed on movable support piers 110 and 130 to permit free longitudinal movement of the superstructure 100 of the bridge. FIG. 6*b* is a schematic view illustrating the deformation of the 4-span continuous bridge of FIG. 6*a* when a seismic load is imparted thereto. Referring to FIG. 6*b*, the seismic load is applied to the superstructure 100 of the bridge in the arrow direction "b" by an earthquake ground motion expressed in the arrow direction "a". The superstructure 100 of the bridge moves in the longitudinal direction of the bridge due to the seismic load. With no frictional force of the movable supports, the seismic load imparted to the superstructure 100 of the bridge would be transmitted only to the fixed support pier 120 through the fixed support 121. The fixed support pier 120 provided with the fixed support 121 would withstand the whole seismic load transmitted from the superstructure 100 of the bridge, and finally be forced to deform as shown FIG. 6*b*. If an excessive seismic load is applied to the fixed support pier 120, the bridge itself as well as the fixed support 121 of the fixed support pier 120 would be seriously damaged, maybe resulting in the failure of the fixed support pier 120.

Seismic isolators, i.e., lead rubber bearings, friction pendulum seismic isolation bearings, etc., are conventionally employed to reduce the seismic load transmitted from the superstructure of the bridge to the piers. It is most convenient if the conventional seismic isolators are installed between the piers and the superstructure from the beginning of the construction of the bridge.

Meanwhile, shock transmitters have been developed to transmit the seismic load not only to the fixed support piers but also to the movable support piers by the aid of high viscosity fluid. To be specific, the apparatus is characterized by a cylinder and rods connecting both ends of the cylinder to the superstructure of the bridge and to the piers. In general the cylinder is divided into two chambers by a sliding piston. The chambers are filled with fluid and connected through an orifice. It allows slow displacement under static load such as temperature load. But it provides temporary restraint under the suddenly applied dynamic load such as earthquakes. This apparatus using viscous fluid, however, should always be kept sealed so as to prevent the fluid from leaking out and the function thereof from deteriorating due to the leakage. For this, the apparatus may need measures for continuous monitoring, maintenance and repair. Further, there may be deterioration in the viscosity of the fluid with the passage of time, possibly inducing loss in efficiency of the impact transmitting apparatus and in earthquake resistance capacity of the bridge.

SUMMARY OF THE INVENTION

It is, therefore, an object of the present invention to provide a seismic load transmitting system based on impact mechanism for a multi-span continuous bridge, which can overcome the disadvantages of the conventional shock transmitters in a mechanical manner in contrast to the conventional seismic isolator.

To achieve the above object, there is provided a seismic load transmitting system based on impact mechanism for a multi-span continuous bridge, which improves its resistance capacity against earthquakes by converting the seismic load transmitted from a superstructure of the bridge into a compressive force and transmitting the same not only to fixed support piers but also to movable support piers.

To be specific, the seismic load transmitting system comprises impact assemblies (or impactors) that are connected to a superstructure of the bridge for colliding with the movable support piers according to longitudinal displacement of the superstructure of the bridge caused by the seismic load and that transmit the seismic load from the superstructure of the bridge to the movable support piers; and impact receiving assemblies (or targets) that are installed in the movable support piers for receiving impact forces generated when the movable support piers collide with the impact assemblies (or impactors) and that transmit the seismic load from the superstructure of the bridge through the impact assemblies to the movable support piers, whereby the seismic load transmitting system can improve the earthquake resistance capacity of the bridge by converting the seismic load generated in the superstructure due to the earthquake into compressive forces due to the collision between the impact assemblies and impact receiving assemblies and transmitting the seismic load to the fixed support piers but also to the movable support piers.

The seismic load transmitting system according to the present invention has also functions of distributing and transmitting impact forces generated at expansion joints of bridge superstructures owing to the causes other than earthquakes.

According to the present invention, the impact assembly includes a main body, said main body being fixed to the superstructure of the bridge at one end thereof and extending toward the impact receiving assembly at the other end thereof, an impact plate being installed at an end of the main body and facing the impact receiving assembly with a predetermined gap therebetween; and a buffer plate made of an elastic material, the buffer plate being provided in front of the end of the impact plate, for reducing impact load generated when the impact assembly is collided with the impact receiving assembly.

The impact receiving assembly may include a base plate attached to the movable support piers for fixing the impact receiving assembly to the movable support piers, a contact plate being in contact with the buffer plate during the collision between the impact assembly and the impact receiving assembly, and an impact absorbing plate being installed between the contact plate and the base pate to absorb the impact force generated during the collision between the impact assembly and the impact receiving assembly.

The impact assembly may further include a plurality of supplemental intermediate metal plates of a predetermined thickness between the impact plate and the rear of the buffer plate, and the contact plate of the impact receiving assembly has a curved surface of predetermined single or double curvature. The surface of double curvature means a curved surface that is defined by horizontal curvature and vertical curvature that can be different from each other.

In the other embodiment, the impact plate, intermediate plates and buffer plate of the impact assembly have curved surfaces of predetermined single or double curvature.

The impact receiving assembly may further comprise an impact absorbing plate being installed between the contact plate and the base plate to absorb the impact force generated during the collision between the impact assembly and impact receiving assembly.

The contact plate in the impact receiving assembly and the buffer plate in the impact assembly may have, respectively, a curved surface of single or double curvature.

The structures of the impact assembly and the impact receiving assembly can be interchanged each other to achieve the functions intended by the seismic load transmitting system of the present invention.

The impact assembly and the impact receiving assembly may be enclosed by a flexible protection hood, respectively. A shear key may be installed at the upper part of the movable support piers, and the impact receiving assemblies may be installed at both sides of the shear key.

BRIEF DESCRIPTION OF THE DRAWINGS

The above and other objects, features and advantages of the present invention will become more apparent from the following detailed description when taken in conjunction with the accompanying drawings, in which:

FIG. 6*b* and FIG. 6*c* are, respectively, a schematic view illustrating a deformation of the conventional continuous bridge of FIG. 6*a* when a seismic load is applied thereto.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

Figure 1A:
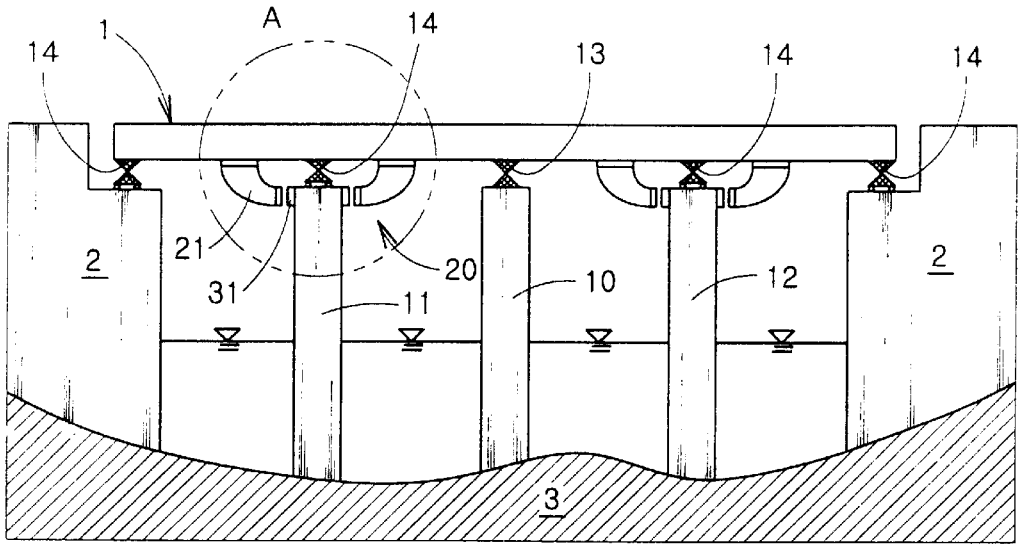
FIG. 1*a* is a schematic view illustrating a 4-span continuous bridge provided with the seismic load transmitting system according to the present invention.

FIG. 1*a* is a schematic view illustrating a 4-span continuous bridge provided with the seismic load transmitting system according to the present invention. A fixed support 13 is installed at the fixed support pier 10, which is located in the middle of the bridge, to restraint the longitudinal movement of the superstructure 1 of the bridge. Respective movable supports 14 are installed at the first movable support pier 11 and the second movable support pier 12 to permit free longitudinal movement of the superstructure 1 of the bridge.

The seismic load transmitting system 20 according to the present invention comprises impact assemblies 21 for applying impact forces to the piers due to the longitudinal displacement of the superstructure 1 of the bridge caused by a seismic load; and impact receiving assemblies 31 for receiving the impact force imparted by the impact assemblies 21 and transmitting the seismic load transferred from the superstructure 1 of the bridge in the form of a compressive force through the impacting assemblies 21 to the piers.

Figure 1B:
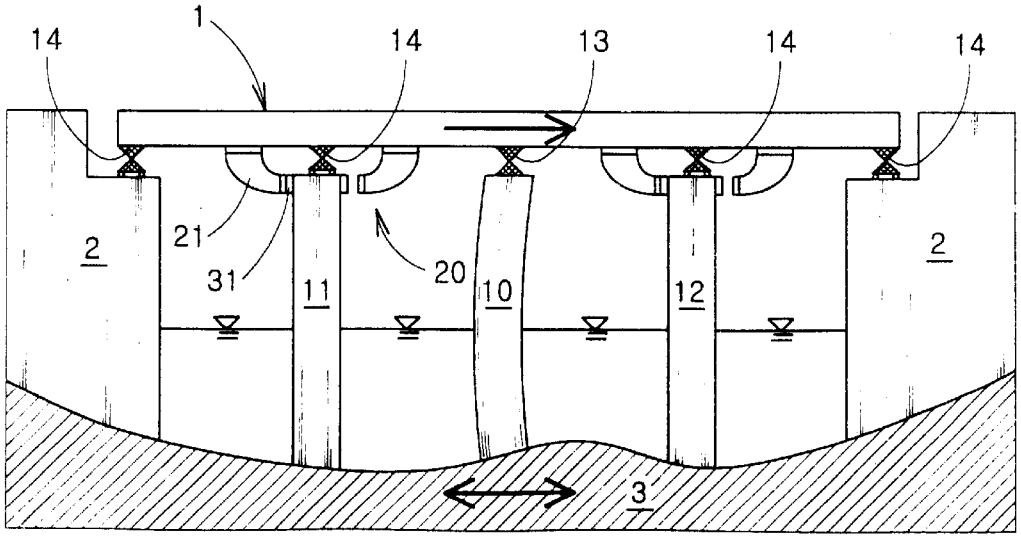
FIG. 1*b* and 1*c* are, respectively, a schematic view illustrating a deformation of the 4-span continuous bridge provided with the seismic load transmitting system of FIG. 1*a* when a seismic load is imparted thereto.
Figure 1C:
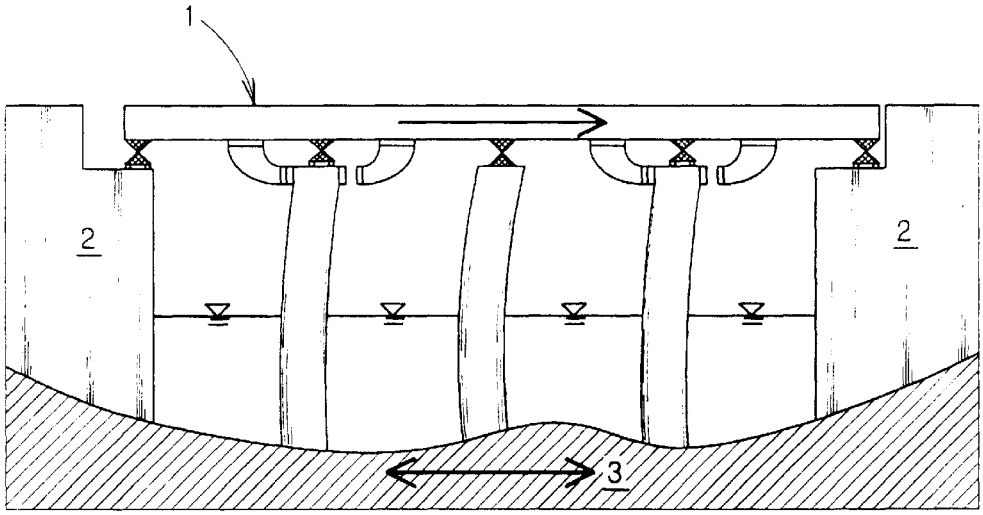
Figure 1D:
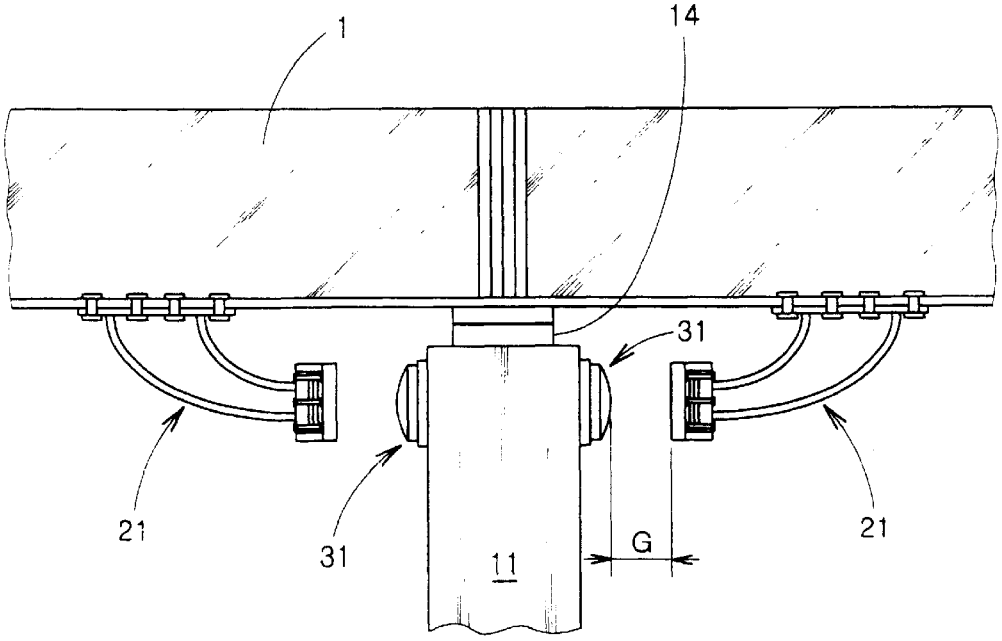
FIG. 1*d* is an enlarged view illustrating a portion indicated at A in FIG. 1*a;*

FIG. 1*d* is an enlarged view illustrating a portion indicated at A in FIG. 1*a*. Referring to FIG. 1*d*, the impact assemblies 21 are connected firmly to the superstructure 1 of the bridge and arranged at both sides of the respective movable support piers 11 and 12. The impact receiving assemblies 31 are attached to both side surfaces of the respective movable support piers 11 and 12.

FIG. 1*b* and FIG. 1*c* are schematic views illustrating the deformation of the 4-span continuous bridge provided with the seismic load transmitting system of FIG. 1*a* when the seismic load is applied thereto. In the state where the seismic load is not applied to the superstructure 1 of the bridge, a predetermined gap (G) is maintained between the end surfaces of the impact assembly 21 and the corresponding impact receiving assembly 31 at one side of the respective movable support piers as shown in FIG. 1*a*. In contrast, once the seismic load is applied to the superstructure 1 of the bridge, the superstructure 1 of the bridge moves in the longitudinal direction. If the longitudinal displacement of the superstructure 1 exceeds the predetermined gap (G) between the impact assembly 21 and the impact receiving assembly 31, a collision takes place between the impact assembly 21 and impact receiving assembly 31, so that the end surface of the impact assembly 21 is forced to be in contact with the impact receiving assembly 31 as drawn in FIG. 1*b*. Until the time when the impact assembly 21 and impact receiving assembly 31 begin to collide with each other, the fixed support pier 11 withstands the total force caused by the displacement of the superstructure 1 of the bridge. If the superstructure 1 of the bridge moves further in the longitudinal direction even after the collision of the impact assembly 21 with the impact receiving assembly 31, the seismic load is being transmitted from the superstructure 1 of the bridge in the form of a compressive force through the impact assembly 21 and the impact receiving assembly 31 to the movable support piers 11 and 12. In this case, the bridge will deform in such a way as shown in FIG. 1*c* that the movable support piers 11 and 12 as well as the fixed support pier 10 accommodate the seismic load. Meanwhile, if the superstructure 1 of the bridge moves in the opposite direction, the impact assembly and impact receiving assembly installed in the other side of the respective movable support piers are operative to Abutments and ground, not shown in FIG. 1*d*, are indicated generally as 2 and 3, respectively.

A construction of the impact assembly 21 and impact receiving assembly 31 according to the preferred embodiment of the present invention will be described herein below with reference to FIG. 2*a* to FIG. 3*c*.

Figure 2A:
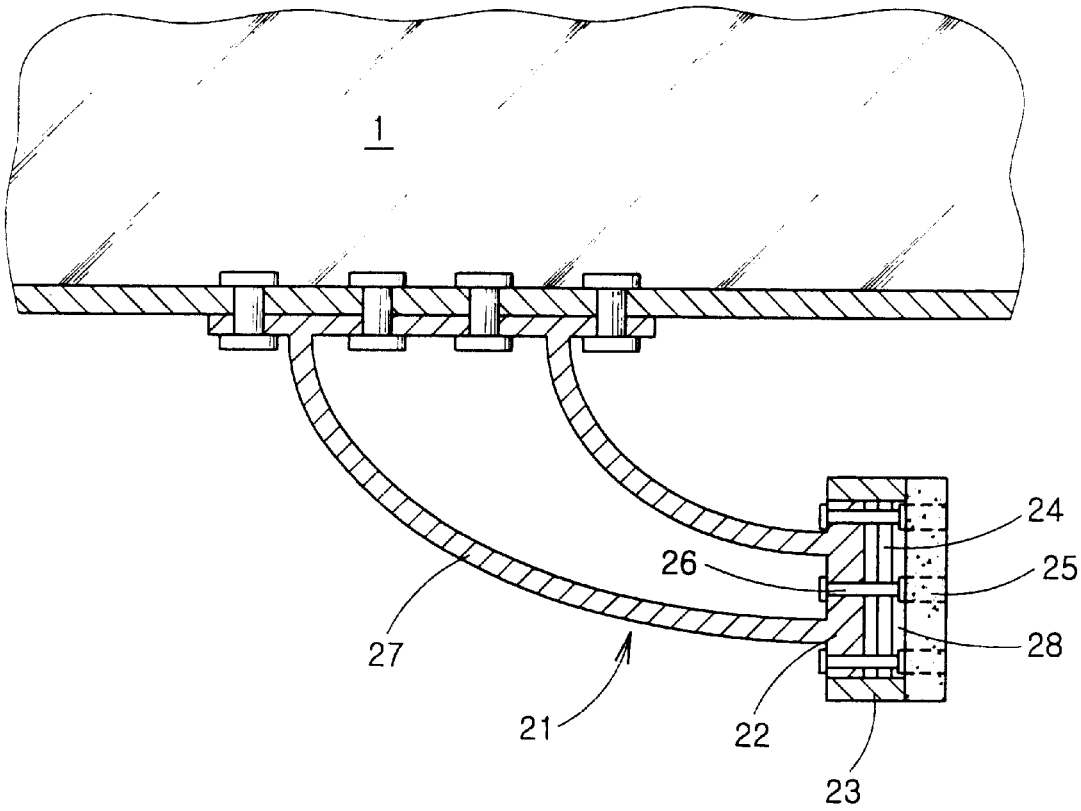
FIG. 2*a* is a schematic side-sectional view illustrating an impact assembly according to a preferred embodiment of the present invention.
Figure 2B:
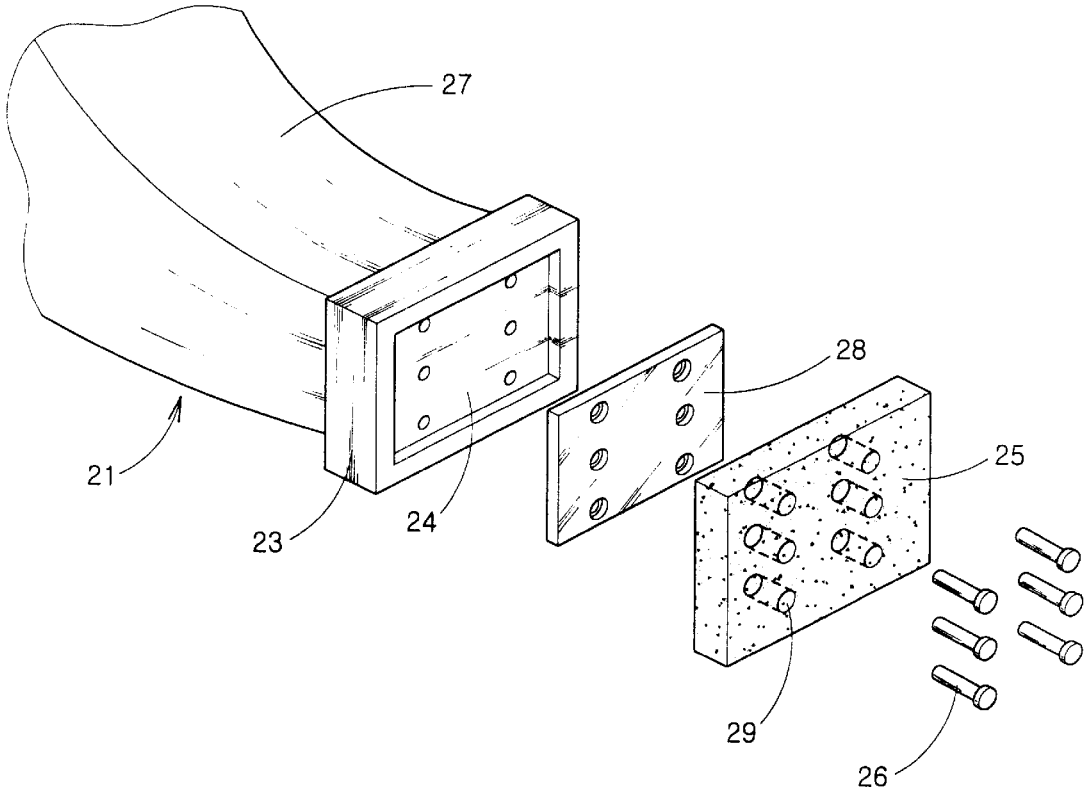
FIG. 2*b* is a schematic view illustrating a front of the impact assembly drawn in FIG. 2*a;*

FIG. 2*a* is a schematic side-sectional view illustrating the impact assembly 21 according to the preferred embodiment of the present invention, whereas FIG. 2*b* is a schematic view illustrating the structure of the impact assembly 21. The impact assembly 21 includes a main body 27, which is fixed to the superstructure 1 of the bridge at one end thereof by a bolt fastening, welding, etc. and extends toward the impact receiving assembly 31 at the other end thereof, and an impact plate 22, which is installed at the other end of the main body 27. The impact plate 22 is provided with a buffer plate 25 made of an elastic material at the front thereof to reduce the impact load generated when the impact assembly 21 collides with the impact receiving assembly 31. For instance, an elastic plate materialized of rubber may be used for the buffer plate 25, which is mounted in such a way to be easily replaceable.

Referring to FIG. 2*b*, an intermediate plate 28 of a predetermined thickness is attached to the rear end of the buffer plate 25. The intermediate metal plates 28 is connected to the impact plate 22 by fastening means 26. Depressed grooves are formed in the intermediate metal plate 28, so that the head of the fastening means 26, including bolts, is not projected out of the surface when the intermediate metal plates 28 is connected to the impact plate 22 by the fastening means. Perforations 29 are formed in the buffer plate 25 to pass the fastening means therethrough. The buffer plate 25 is attached integrally to the intermediate layer of metal plates 28 by means of adhesives or the like.

A plurality of supplemental intermediate metal plates 24 having a predetermined thickness can be installed between the impact plate 22 and the intermediate metal plate 28. The gap (G) (as seen in FIG 1*d*) between the impact assembly 21 and the impact receiving assembly 31 is easily adjustable by controlling the number of the supplemental intermediate metal plates 24, and further, the stress and deformation applied to the impact plate 22 are easily maintainable within a predetermined range by controlling the number of the supplemental intermediate metal plates 24. Referring to FIG. 2*a*, the supplemental intermediate metal plates 24 are preferably installed by the aid of the fastening means 26, such as bolts, so as to be easily replaced, added, or removed, but they are not limited to this installation method.

An envelop 23 may be formed around the impact plate 22 and have a predetermined size large enough to envelop the intermediate metal plate 28 or the supplemental intermediate metal plates 24.

Figure 3A:
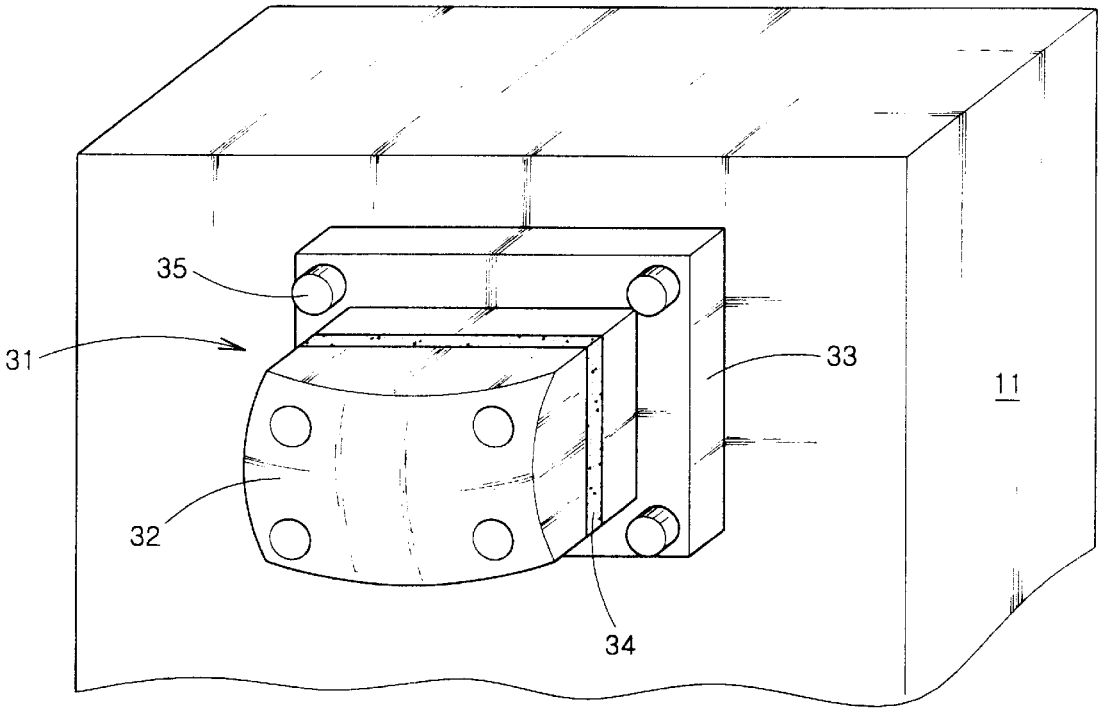
FIG. 3*a* is a schematic view illustrating an impact receiving assembly according to the preferred embodiment of the present invention.
Figure 3B:
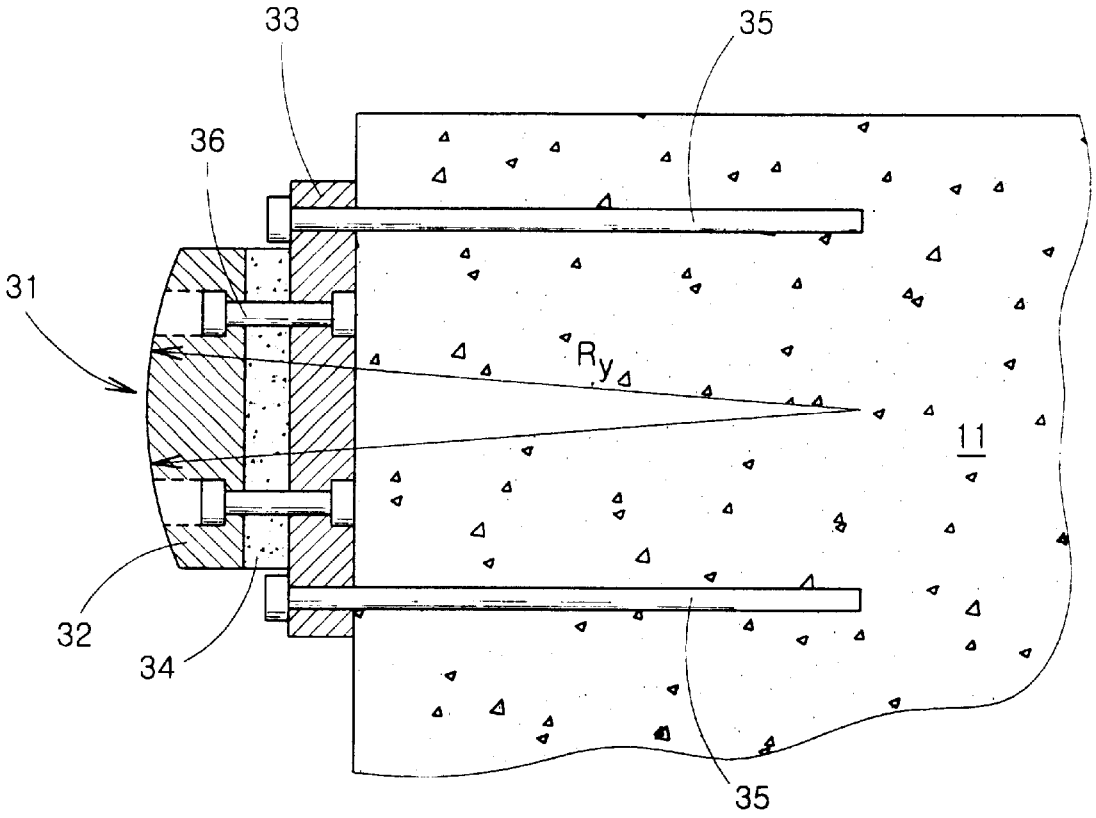
FIG. 3*b* is a schematic side-sectional view illustrating the impact receiving assembly drawn in FIG. 3*a;*
Figure 3C:
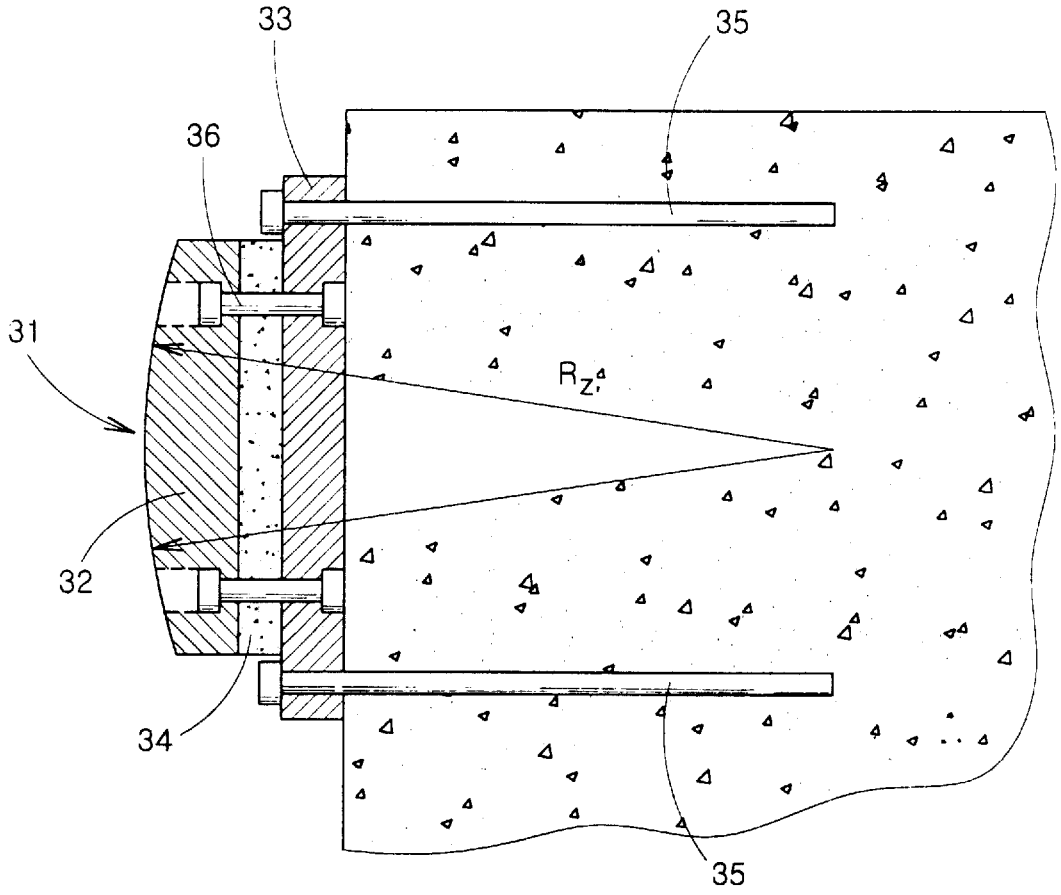
FIG. 3*c* is a plan-sectional view illustrating the impact receiving assembly of FIG. 3*a* eyed from the top of a pier.

FIG. 3*a* is a schematic view illustrating the impact receiving assembly 31 according to the preferred embodiment of the present invention, while FIG. 3*b* is a schematic side-sectional view illustrating the impact receiving assembly 31. Furthermore, FIG. 3*c* is a schematic plan-sectional view illustrating the impact receiving assembly 31 eyed from the superstructure of the bridge. The impact receiving assembly 31 includes a contact plate 32 with which the buffer plate 25 of the impact assembly 21 is directly in contact during the collision between the impact assembly 21 and the impact receiving assembly 31, and a base plate 33 for fixing the impact receiving assembly 31 to the movable support piers 11 and 12. An impact absorbing plate 34 is preferably installed between the contact plate 32 and the base plate 33 to absorb the impact force generated due to the collision between the impact assembly 21 and the impact receiving assembly 31. The impact absorbing plate 34 is preferably materialized of a metal having a high impact absorbing capacity and a predetermined thickness.

As drawn in FIG. 3*b*, the base plate 33 is integrally fixed to a side of the movable support pier 12 by means of anchor bolts 35, etc., and the contact plate 32 and the impact absorbing plate 34 are fixed to the base plate 33 by the fastening means 36 including bolts. In particular, if the end of the fastening means 36 for connecting the contact plate 32 and impact absorbing plate 34 protrudes out of the surface of the contact plate 32, the buffer plate 25 of the impact assembly 21 and the fastening means 36 itself may be damaged because of the protruded end of the fastening means 36 during the collision with the impact assembly 21. Hence, the end of the fastening means 36 is preferably kept within the contact plate 32.

In the event that the contact plate 32 in the impact receiving assembly 31 and the buffer plate 25 in the impact assembly 21 are all of flat surfaces, it is possible that both surfaces of the contact plate 32 and the buffer plate 25 are not accurately opposite to each other due to construction errors, thermal changes, deflection of the bridge, etc. In this case, if the impact assembly 21 collides with the impact receiving assembly 31, the buffer plate 25 or contact plate 32 would suffer a local stress concentration, increasing the possibility of damage thereto and failing to efficiently transmit the seismic load from the superstructure of the bridge to the piers.

To solve the problems, the surface of the contact plate 32 in accordance with the present invention is designed to have predetermined single or double curvatures. Specifically, it is more desirable in consideration of diverse effects including the construction errors, thermal changes, etc. that the surface of the contact plate 32 has predetermined double curvatures. That is, the surface of the contact plate 32 has two different curvatures, namely, a vertical curvature ($R_y$) in FIG. 3*b* and a horizontal curvature ($R_z$) in FIG. 3*c*

Accordingly, even if there exists a slight variation in the position of the contact plate 32 or buffer plate 25 owing to the construction errors, thermal changes, etc., the collision of the impact assembly 21 with the impact receiving assembly 31 does not build up the local stress and the seismic load can be efficiently transmitted from the superstructure of the bridge to the piers.

According to another embodiment of the present invention, the buffer plate 25 of the impact assembly 21 is formed to have a curved surface with double curvatures like the above, but the contact plate 32 of the impact receiving assembly 31 may have a level surface.

Figure 4:
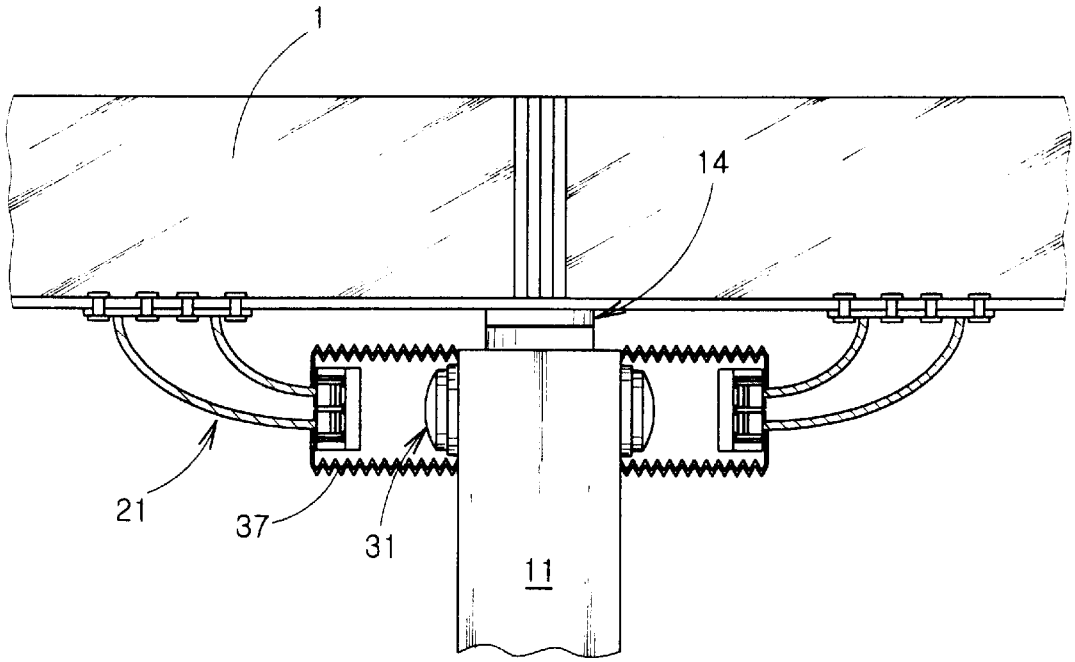
FIG. 4 is a schematic view illustrating a shape of the seismic load transmitting systems provided with protection hoods.

In the meantime, the impact assembly 21 and the impact receiving assembly 31 are preferably enclosed by a flexible protection hood 37 to be protected from the adverse environmental effects as shown in FIG. 4.

Figure 5A:
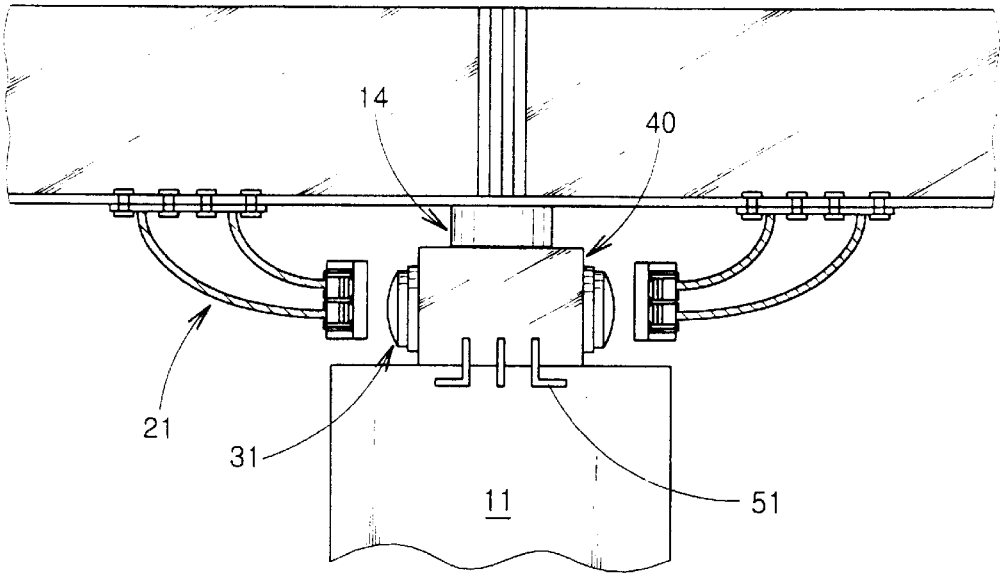
FIG. 5*a* and FIG. 5*b* are, respectively, a schematic view illustrating another installation of the seismic load transmitting system according to the present invention.
Figure 5B:
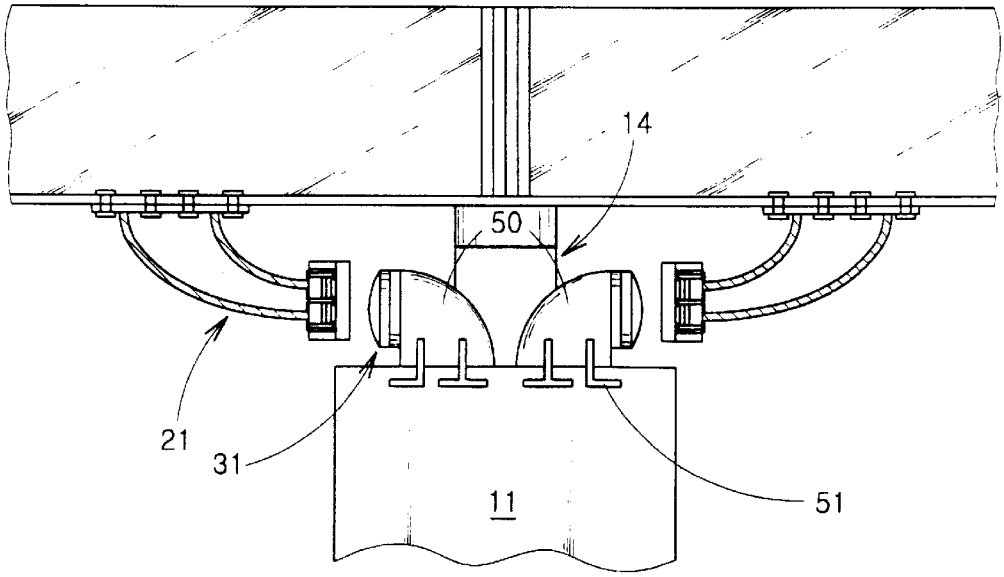
Figure 6A:
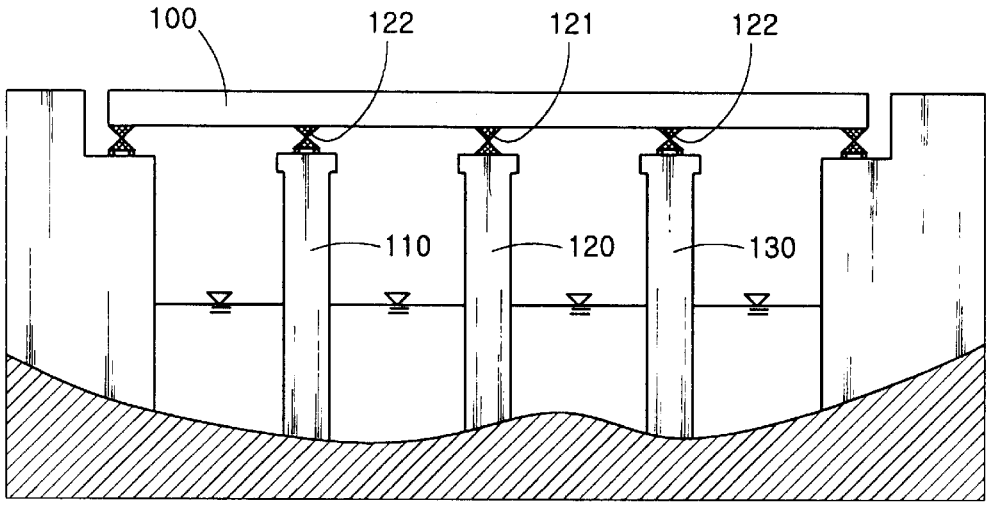
FIG. 6*a* is a schematic view illustrating a conventional 4-span continuous bridge.
Figure 6B:
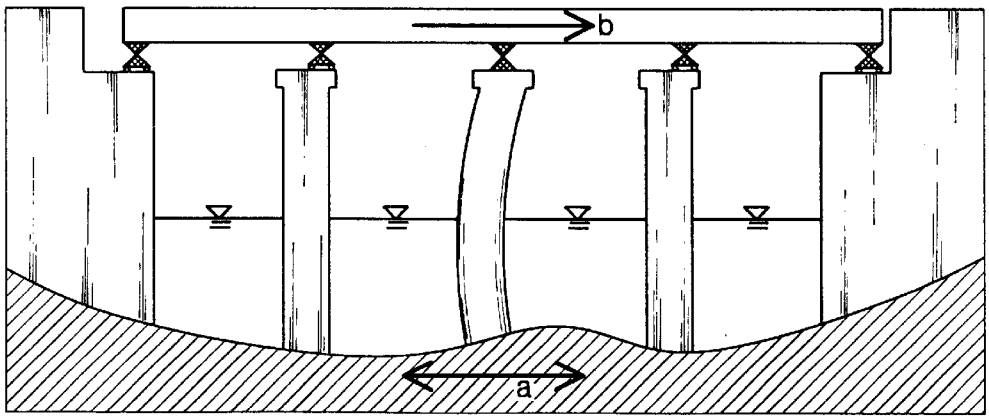

In the above preferred embodiments of the present invention, the impact receiving assemblies 31 are installed at both sides of the respective movable piers 11 and 12. Still another preferred embodiment of the present invention herein below is also available to be used. That is, a shear key 40 having a predetermined height is fixed at the center of the upper part of the respective movable piers 11 and 12, and the impact receiving assemblies 31 may be installed at both sides of the shear key 40 as shown in FIG. 5*a*. Further, individual shear keys 50 are fixed to the movable piers 11 and 12 and the impact receiving assemblies 31 may be installed at the individual shear keys 50 as shown in FIG. 5*b*. Fastening means including anchor bolts indicated generally as 51 in FIG. 5*a* and FIG. 5*b* is used to integrate the separately built shear keys 40 and 50 with the movable piers 11 and 12.

In addition, if the system according to the present invention is installed between the superstructure 1 of the bridge and the abutment 2, it can function as a system for preventing falling down of the bridge superstructure.

In the case that the fixed support does not have sufficient lateral load carrying capacity, then a premature failure will be resulted. To prevent such a problem, the seismic load transmitting system of the present invention can be installed at the fixed support pier. But the impact assemblies and the impact receiving assemblies should be arranged in such a way to prevent the failure of the fixed supports during the deformation of the fixed support pier.

In the similar way, the present invention can be used to transmit the seismic load acting in transverse direction from the super structure to the piers of the bridge. The transverse direction means the horizontal direction perpendicular to the longitudinal direction of the bridge. In this case, the seismic load transmitting systems will be installed at the sides of the piers perpendicular to the transverse direction of the bridge.

The structures of the impact assembly and the impact receiving assembly can be interchanged with each other to achieve the functions intended by the seismic load transmitting system of the present invention.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A seismic load transmitting system based on impact mechanism for a multi-span continuous bridge, the system comprising:

impact assemblies connected to a superstructure of the bridge for colliding with movable support piers according to a longitudinal displacement of the superstructure of the bridge caused by seismic load and for transmitting the seismic load from the superstructure of the bridge to the movable support piers; and impact receiving assemblies installed at the movable support piers for receiving impact forces generated when the impact assemblies collide with the movable support piers and for transmitting the seismic load transferred from the superstructure of the bridge through the impact assemblies to the movable support piers; and wherein said impact assembly includes a main body, said main body being fixed to said superstructure of the bridge at one end thereof and extending toward said impact receiving assembly at the other end thereof;

an impact plate, the impact plate being installed at an end of the main body and facing said impact receiving assembly with a predetermined gap therebetween;

a buffer plate made of an elastic material, the buffer plate being provided at the front of the end of the impact plate, for reducing impact load generated when said impact assembly collides with said impact receiving assembly; and wherein said impact receiving assembly includes a base plate attached to the movable support piers for fixing said impact receiving assembly to the movable support piers;

a contact plate being in contact with the buffer plate when the collision between said impact assembly and said impact receiving assembly;

an impact absorbing plate being installed between the contact plate and the base plate to absorb the impact force generated in case of the collision between said impact assembly and said impact receiving assembly.

2. The system of claim 1, wherein said impact assembly and said impact receiving assembly are enclosed by a flexible protection hood, respectively.

3. The system of claim 1, wherein said impact assembly further includes a plurality of supplemental intermediate metal plates of a predetermined thickness installed at the rear of said buffer plate.

4. The system of claim 1, wherein said contact plate in said impact receiving assembly has a curved surface of single or double curvatures.

5. The system of claim 1, wherein said impact plate, intermediate plates and buffer plate of said impact assembly has curved surfaces of predetermined single or double curvature.

6. The system of claim 1, wherein said impacting assembly comprises a base plate, an impact absorbing plate and a contact plate of curved surface of single or double curvatures; and wherein said impact receiving assembly comprises a buffer plate, an intermediate metal plate and a base plate anchored to the pier by interchanging the structures of impacting assembly and impact receiving assembly with each other.

7. The system of claim 1, wherein a shear key is installed at the upper part of the movable support piers, and said impact receiving assemblies are installed at both sides of the shear key.

* * * * *